US009826784B1

(12) United States Patent
Cutrona et al.

(10) Patent No.: US 9,826,784 B1
(45) Date of Patent: Nov. 28, 2017

(54) BRA WITH A POCKET

(71) Applicant: Booby Trap Bras, LLC, Wimberley, TX (US)

(72) Inventors: Jennifer Cutrona, Wimberley, TX (US); Joseph Cutrona, Wimberley, TX (US)

(73) Assignee: Booby Trap Bras, LLC, Wimberley, TX (US)

( * ) Notice: Subject to any disclaimer, the term of this patent is extended or adjusted under 35 U.S.C. 154(b) by 0 days.

(21) Appl. No.: 15/239,571

(22) Filed: Aug. 17, 2016

(51) Int. Cl.

| | |
|---|---|
| ***A41C 3/00*** | (2006.01) |
| ***A41C 3/08*** | (2006.01) |
| ***A41F 1/00*** | (2006.01) |
| ***A41F 15/00*** | (2006.01) |
| ***A45F 5/14*** | (2006.01) |
| ***B26B 29/02*** | (2006.01) |

(52) U.S. Cl.
CPC ..... *A41C 3/0035* (2013.01); *A41C 3/08* (2013.01); *A41F 1/006* (2013.01); *A41F 15/002* (2013.01); *A45F 5/14* (2013.01); *B26B 29/025* (2013.01)

(58) Field of Classification Search
CPC ... A41C 3/0035; A41D 13/0012; A45F 5/021; A45F 5/14; B26B 29/025
USPC ..... 450/89, 39; 2/102, 108, 94, 95, 85
See application file for complete search history.

(56) References Cited

U.S. PATENT DOCUMENTS 4,759,483 A * 7/1988 Willoughby ..... A45F 5/14 224/232
4,942,663 A * 7/1990 Ray, Sr. ..... B26B 29/025 224/183
5,009,348 A * 4/1991 Derkatz ..... B26B 29/025 224/232
5,022,887 A * 6/1991 Lawson ..... A41C 3/10 2/267
5,247,707 A * 9/1993 Parker ..... A41D 13/0012 2/102
6,083,080 A * 7/2000 Lawson ..... A41C 3/0057 450/39
6,110,005 A * 8/2000 Stephenson ..... A41C 3/0057 450/39
6,427,340 B1 * 8/2002 Cohen ..... B26B 29/02 224/183
7,442,110 B2 * 10/2008 Gaudet ..... A41C 3/0057 450/39
9,060,550 B2 6/2015 Conrad
2003/0006257 A1 * 1/2003 Aberman ..... A45F 5/021 224/232
2007/0298684 A1 * 12/2007 Spagna ..... A41C 3/0035 450/89

(Continued)

*Primary Examiner* — Gloria Hale

(74) *Attorney, Agent, or Firm* — McKee, Voorhees & Sease, PLC

(57) ABSTRACT

An article of clothing providing a pocket for safely and securing concealing a self-defense device in an easily accessible location. The article of clothing may be a bra or tank-top having a pocket or sheath made of a cut-resistant material and configured for removably securing a knife or dagger. The pocket may also be configured to removably secure an aerosol canister containing a chemistry configured to deter an attacker, such as pepper spray. In one embodiment, the article of clothing is a bra with a pocket position between the two cups of the bra. The pocket is configured to removably secure a sheath made of a cut-resistant material, wherein the sheath is configured to removably secure a knife or dagger.

19 Claims, 6 Drawing Sheets

(56) References Cited

U.S. PATENT DOCUMENTS

| | | | | |
|---|---|---|---|---|
| 2008/0261489 | A1* | 10/2008 | Sweeney | A41C 3/0035 450/39 |
| 2009/0209173 | A1* | 8/2009 | Arledge | A41C 3/0035 450/39 |
| 2015/0289570 | A1 | 10/2015 | Conrad | |

* cited by examiner

BRA WITH A POCKET

FIELD OF THE INVENTION

The invention relates generally to bra undergarments with a pocket. More specifically, but not exclusively, the invention relates to a bra with a pocket that includes a sheath. Even more specifically, but not exclusively, the invention relates to a bra with a sheath for holding a knife or aerosol spray canister.

BACKGROUND OF THE INVENTION

The fashion industry is constantly developing and ever-changing in an effort to stay current with popular trends. In keeping up with these changing trends, fashion apparel and fashion accessories are required to adapt and develop in order to provide the individual with a comfortable fit and proper style. Fashion apparel ranges from formal wear to sportswear and is available for men, women, and children alike.

A popular fashion industry, and the area of the present disclosure, pertains to women's wear, and more specifically, women's athletic wear and related undergarments. The fashion industry with regard to men's and women's sports or athletic undergarments and apparel is trending towards tighter fitting compression-like items. One particular undergarment most or all women wear while jogging or participating in an athletic or exercise type activity is a bra to support their breasts. A bra including a pocket is known in the art. These pockets have been traditionally used to carry a person's identification or some type of music listening device, such as a cell phone or MP3 player. However, it would be dangerous and/or uncomfortable to carry a sharp item, such as a knife.

While jogging or exercising, women may be particularly vulnerable to an attacker, particularly when exercising alone and/or distracted by listening to music using headphones. With the trend in fashion industry of more formfitting workout and athletic apparel, it can be awkward, difficult or uncomfortable to carry items used in self-defense. Furthermore, many exercise garments lack pockets. Carrying a knife or pepper spray canister in the hand while jogging or exercising is not desirable as it is cumbersome. Existing devices use a clip to secure the knife or pepper spray out of the way. However, depending on the location where the knife or pepper spray may be clipped on the person, the knife or spray may not be immediately accessible in the event a person is attacked by surprise. This reduces a woman's ability to quickly respond to and deter an attacker. Additionally, a clip can be cumbersome while exercising, as its single attachment point permits movement or rotation of the knife or pepper spray during exercise, and its external attachment (i.e. on a waistband) may be bulky and inhibit movement.

Therefore, there exists a need in the art for a means of carrying a knife or aerosol can of pepper spray in safe and easily accessible location that overcomes the deficiencies in the art. A knife and/or pepper spray can help both to immobilize an attacker and create a greater sense of security overall.

BRIEF SUMMARY OF THE INVENTION

Therefore, it is a primary object of the invention to overcome the deficiencies in the art by providing a less cumbersome manner of carrying a knife and/or container of pepper spray in a concealed yet easily accessible location.

It is thus an object, feature, and/or advantage of the present disclosure to provide a garment with a built-in pocket and/or sheath for holding a knife.

Another object, feature, and/or advantage of the present disclosure is to provide a bra with a pocket and/or sheath for holding an aerosol spray canister; wherein the aerosol canister may comprise pepper spray or similar chemistry that may be utilized to deter and/or neutralize a potential attacker.

Still another object, feature, and/or advantage of the present disclosure is to provide a bra including two or more layers of fabric, wherein a cut-resistant pocket may be formed between the layers of fabric.

Still yet another object, feature, and/or advantage of the present disclosure is to provide a bra including a pocket formed between two or more layers of fabric; wherein the pocket is configured to removably secure a knife sheath made of a cut-resistant fabric.

Yet another object, feature, and/or advantage of the present disclosure is to provide a knife that is specially designed to be form-fit for the sheath and built into a bra, wherein the knife is safely secured and easily removable.

Still yet another object, feature, and/or advantage of the present disclosure is to provide a pocket or sheath in a bra or similar garment, such that the pocket and/or sheath provides immediate access to a knife or aerosol container for deterring and immobilizing attackers.

Still yet another object, feature, and/or advantage of the present disclosure is to provide a bra including a sheath made of a webbed nylon material, wherein the webbed nylon is resistant to cutting or fraying.

It is still another object, feature, and/or advantage of the present disclosure to provide an article of clothing, such as a sports bra, tank top, bodysuit, dress or the like, that includes a pocket for safely removably securing an item or device used in self-defense such that the item will not be unintentionally removed from the pocket during physical activity, including dancing, jogging, tennis, or any other athletic or physical activity.

It is still yet another object, feature, and/or advantage of the present disclosure to provide a method of manufacturing a bra with a pocket for removably securing a knife, dagger, aerosol canister, or other item that may prevent, deter, or immobilize a potential attacker.

These and/or other objects, features, and advantages of the invention will be apparent to those skilled in the art. The invention is not to be limited to or by these objects, features and advantages. No single embodiment need provide each and every object, feature, or advantage.

According to an aspect of the disclosure, a bra includes a front portion having a pair of cups. Each of the pair of cups may have a strap extending laterally from the front portion toward a rear portion of the bra. The front portion and strap(s) may be a unitary or homogenous piece of fabric, or the strap portion(s) may be attached to the front by a sewn in seam or by a hook and loop locking feature. The bra may also include shoulder straps extending superiorly over the shoulders of the wearer to help keep the bra in place. In some embodiments, the shoulder strap can be divided into a front portion and a rear portion connected by a ring structure. The shoulder straps often connect to each of the pair of cups at the apex of the cups.

According to another aspect of the present disclosure, the back portion can include an attachment member, such as a clasp, zipper, or hook and loop/eye locking feature. The hook and loop locking feature of the back portion may removably connect opposing sides of the back portion to one another, securing the bra in place on the wearer. Alternatively, the back portion may be permanently connected to each of the pair of cups by the side straps, and each of the cups are removably connected to one another with a clasp located proximate to the center of the front portion of the bra.

According to still another aspect of the present disclosure, a bra includes a pocket or sheath that is made from a cut-resistant material. The pock may be removably attached or permanently secured to or within the bra. The pocket or sheath may be located on the front portion of the bra between the cups, or is may also be located on the side or back of the bra. The pocket or sheath may be configured to removably secure a knife, dagger, or aerosol canister. The pocket should be configured and/or oriented such that the knife and/or canister is secured while running or working out, yet the wearer should be able to quickly and easily retrieve the knife or canister if/when needed.

Figure 1:
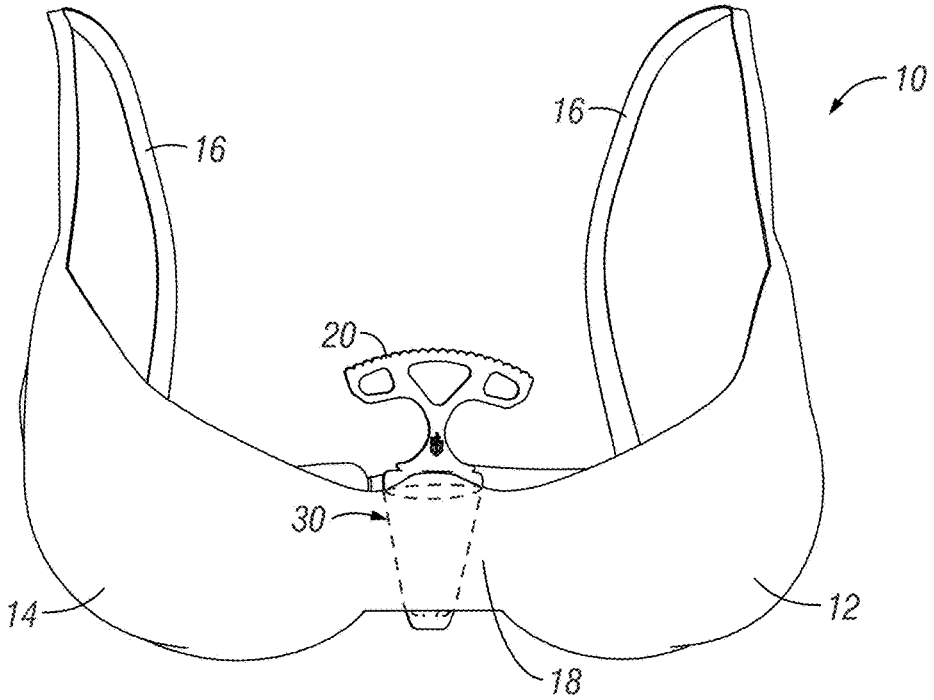
FIG. 1 is a front perspective view of the present invention, including a bra with built-in sheath for holding a knife.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The embodiments of this invention are not limited to a particular style of sheath and/or a particular style or design of knife, as these can vary and are understood by those skilled in the art. It is further to be understood that all terminology used herein is for the purpose of describing particular embodiments only, and is not intended to be limiting in any manner or scope.

Figure 3:
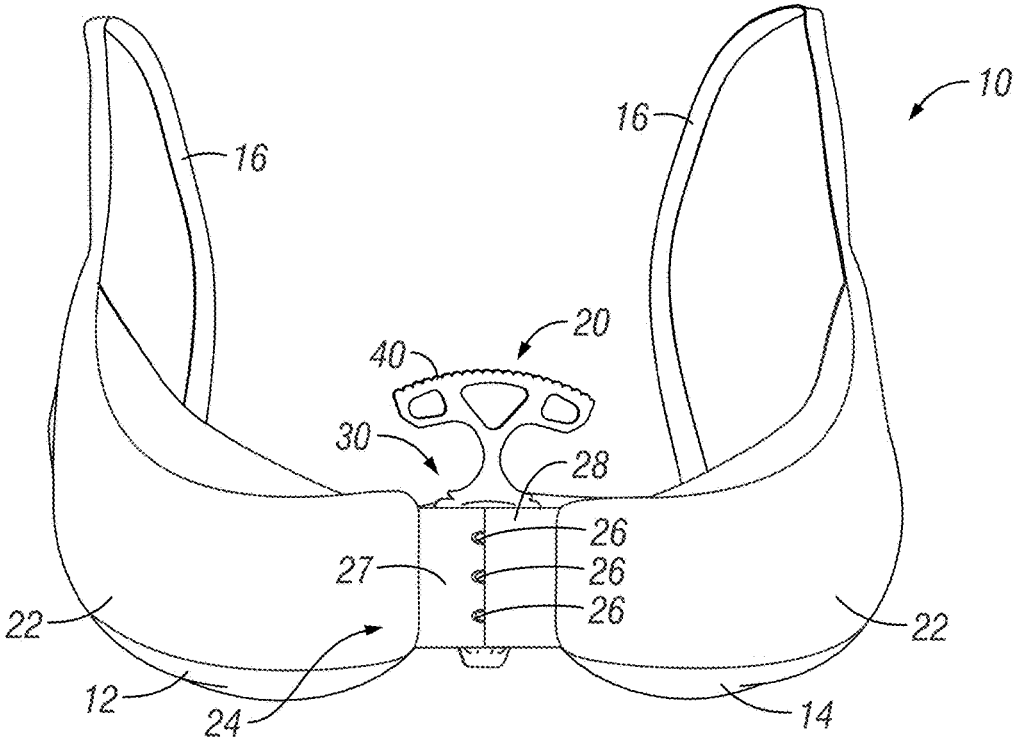
FIG. 3 is a rear perspective view of the bra of FIG. 1.

The invention is generally directed towards a bra 10 that may include a pocket and/or sheath 30 for the purpose of holding a personal protection item, such as a knife 20 or aerosol spray canister. Referring to FIG. 1, an exemplary bra 10 is illustrated. The bra 10 comprises a front portion 18 and a back portion 24 that are connected by side portions 22, which may also be referred to as side straps or wings. The side portions 22 extend laterally from the front portion 18 and are generally configured to wrap around the torso of the wearer. The side straps 22 may extend laterally from the front portion 18 to the rear portion 24 of the bra 10. The side straps 22, front portion 18, and the back portion may be a unitary or continuous piece of fabric, or may include one or more seams. For example, the front portion 18 may be a single piece of fabric, with the side portions 22 attached at the edges of the front portion 18; wherein the side portions 22 may be attached to the front portion 18 by a sewn seam, by Velcro, by a loop and hook clasp, or similar attachment member. The present disclosure also contemplates the locking features 26 can include buttons, zippers, adhesion stitching and keyholes. As illustrated in FIG. 3, the hook and loop/eye closure 26 can be comprised of one or more sets of eyes, providing the wearer the ability to effectively adjust the size of the bra 10. The same may be true for attaching the side straps 22 to the front 18 and/or back portions 24.

The front portion 18 may generally comprise a front left region 12 and a laterally opposing front right region 14. These regions may be commonly referred to as the left cup 12 and the right cup 14. The cups 12 and 14 are generally formed and configured to secure and support a wearer's breasts. The bra 10 may also include one or more flexible shoulder strap portions 16 connecting and supporting the front 18 and back portions 24. Shoulder straps 16 can extend superiorly over the shoulders of the wearer to help keep the bra 10 in place. In some embodiments, the shoulder strap 16 can be divided into a front portion and a rear portion connected by a ring structure. The shoulder straps 16 often connect to each of the pair of cups 12 and 14 at the apex of the cups 12 and 14. The shoulder straps 16 can include any number of rings and/or sliders to provide adjustment of the same. Furthermore, the shoulder straps 16 may include multiple straps, a racerback design, a v-strap design, an x-strap design, or similar configuration known in the art of bras and/or sports bras. It is also contemplated in the present disclosure that the bra 10, may be strapless, e.g. not include any shoulder straps. In this embodiment, all support to the wearer would be provided by the front portion 18 (including the cups 12, 14) and the straps 22, and back portion 24 of the bra 10, as secured around the torso of the wearer.

The front portion 18 may be comprised of a generally flexible material capable of receiving and holding the wearer's breasts, while the back portion 24 may also comprises a flexible material capable of supporting the front portion 18. The material may include spandex, Supplex ®, neoprene, mesh, or similar materials. Fabrics that are fast drying, provide sweat wicking, and/or other features that help to keep the wearer cool and dry may be preferred. However, it is also contemplated in the present disclosure that the bra 10 may be manufactured from cotton, cotton blend, wool, linen, nylon, nylon blends, and the like.

Figure 9:
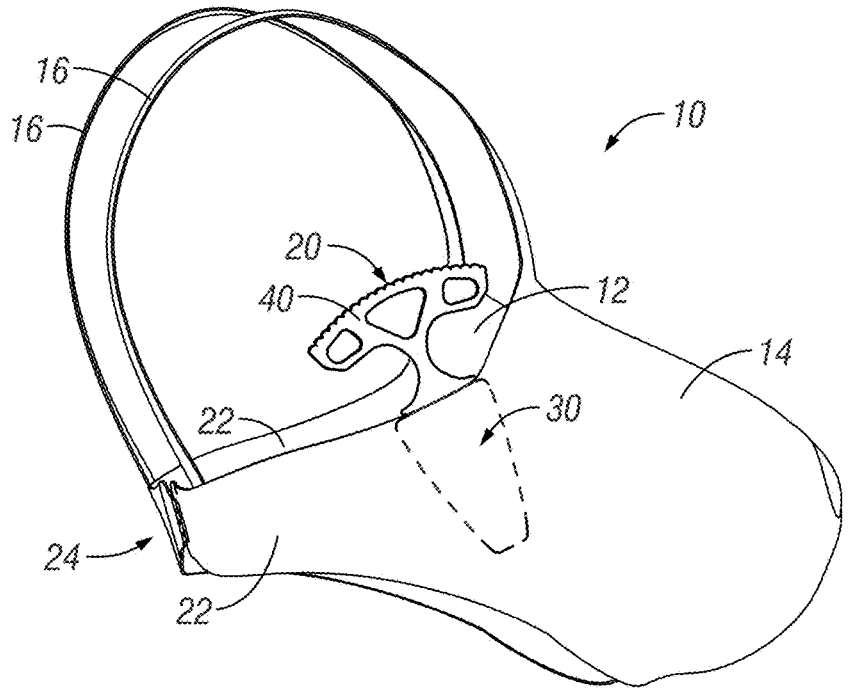
FIG. 9 is a left side view of the bra showing an alternative location for the sheath and knife.
Figure 10:
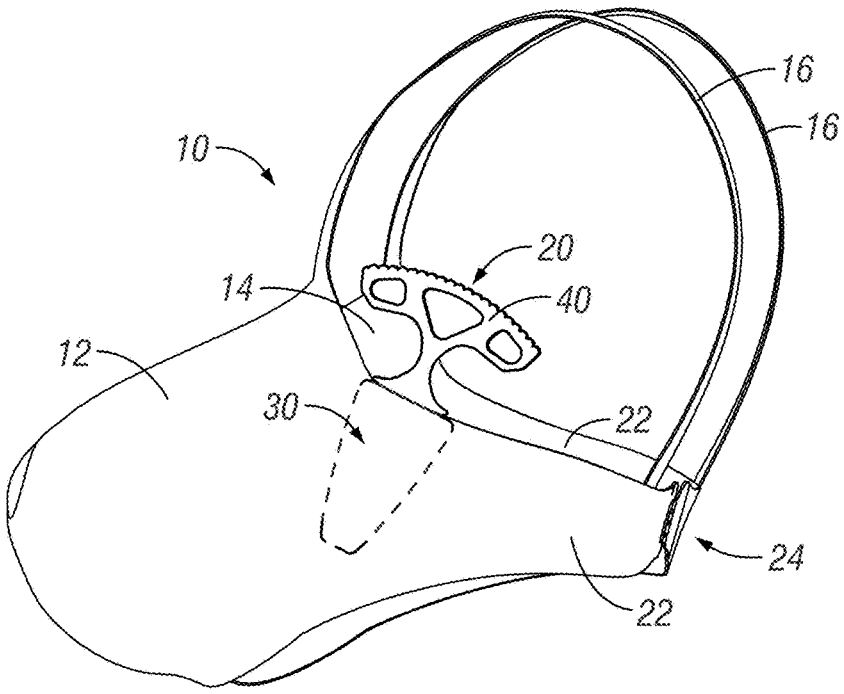
FIG. 10 is a right side view of the bra showing an alternative location for the sheath and knife.

A clasp 26 for the bra 10 may be optionally included and placed in the front 18 or back portion 24 of the bra 10. The present disclosure also contemplates the locking features 26 can include buttons, zippers, adhesion stitching and keyholes. The front portion 18 and the back portion 24 may comprise multiple layers of fabric. Padding may be placed in the front portion 18 between the two layers of fabric to provide greater comfort and support for the wearer. A pocket 30 may also be formed between the layers of fabric of the bra 10. In such a case, the two or more layers may be sewn in a pattern similar to the pocket 30 shown in FIGS. 5 and 6, leaving an opening for the knife 20 or other item to be inserted between the two or more layers of fabric. For example, the front portion 18 of the bra 10 may include two or more layers of fabric, wherein a pocket 30 may be formed between the layers of fabric. The location of the pocket formed between the layers of fabric may vary. For example, the pocket 30 may be formed in the front portion 18 of the bra 10 between the left cup 12 and the right cup 14, as shown in FIG. 1. The pocket 30 may also be formed within the straps 22, as shown in FIGS. 9 and 10. While not shown, it should be understood that the pocket may also be incorporated into or formed within the shoulder straps 16 or the back portion 24. Furthermore, while the pocket 30 is shown in FIGS. 1, 9, and 10, to orient the knife 20 in a generally upright or vertical position relative to the bra 10, it should also be understood that the pocket 30 can be positioned and/or oriented such that the knife 20 may be oriented in a generally lateral or downward position. The position and/or orientation of the pocket 30 may be adapted and/or adjusted to ensure the knife 20 is easily and readily accessible to the wearer.

Figure 2:
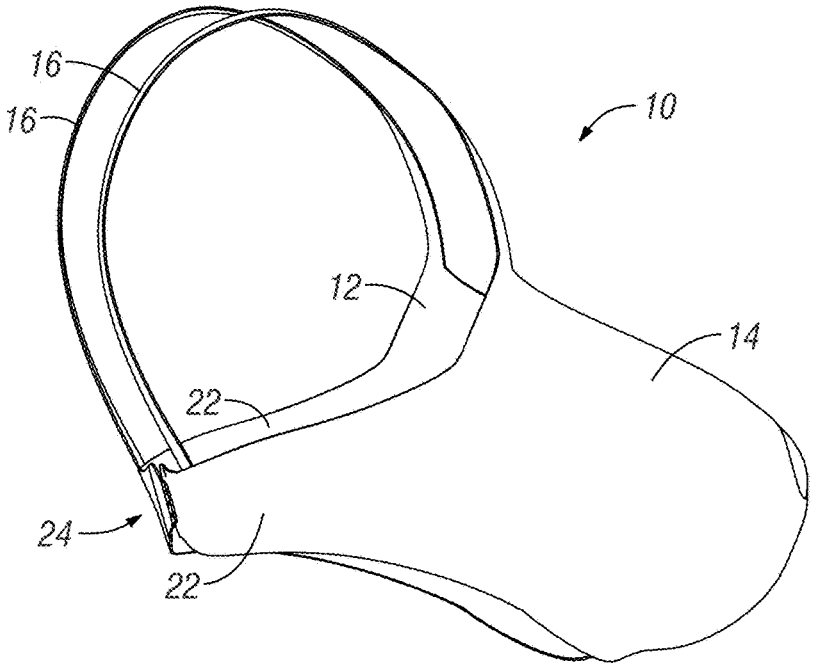
FIG. 2 is a side perspective view of the bra of FIG. 1.

A side view of an exemplary embodiment of the bra 10 is shown in FIG. 2. As shown, the straps 22 extend from the cup portions 12 and 14 of the bra 10, and are configured to wrap around the torso of the wearer. Shoulder straps 16 may extend from the apex or top portion of the cusp 12 and 14, wherein they extend over the wearers shoulder and are attached to the rear or back portion 24 of the bra 10. The shoulder straps are configured to provide support to the wearer's breast and help secure the bra in place on the wearer. The shoulder straps 16 may be configured in various patterns or designs. The shoulder straps 16 may also include a loop or slider to provide adjustment of the length of the straps 16. Generally, the shoulder straps may be made of a stretchable material or fabric, but it is also contemplated that the strap 16 may be made of a plastic, rubber, leather, or other similar material.

FIG. 3 represents a rear perspective view of an embodiment of the bra 10. The bra 10 includes a back portion 24. The back portion 24 has a first end 27 and a second end 28. Both the first end 27 and the second end 28 include counter-posing locking features 26. The counter-posing locking features 26 are configured to removably connect the first 27 and second ends 28 of the bra 10. In a preferred embodiment, the locking features 26 include hooks configured to removably connect to the eyes or loop, resulting in a hook-and-eye closure system commonly known in the art. The present disclosure contemplates alternative counter-posing locking features 26 as disclosed herein. Further, the present disclosure contemplates that the first end 27 and the second end 28 can include the same or different counter-posing locking features 26.

The back portion 24 and/or side straps 22 can be of any thickness sufficient to support the bra 10 around the torso of the wearer. In an exemplary embodiment, the thickness of the back portion 24 is substantially equal to the thickness of the connecting portion of the front portion. For example, the thickness of the back portion may be substantially equal to the thickness of the side straps 22, which may be substantially the same thickness as the portion of the cups 12, 14 which the straps 22 extend from. In such a configuration, a consistent transition from the back portion 24 to the outer cups 12, 14 may be provided by the straps 22.

Figure 4:
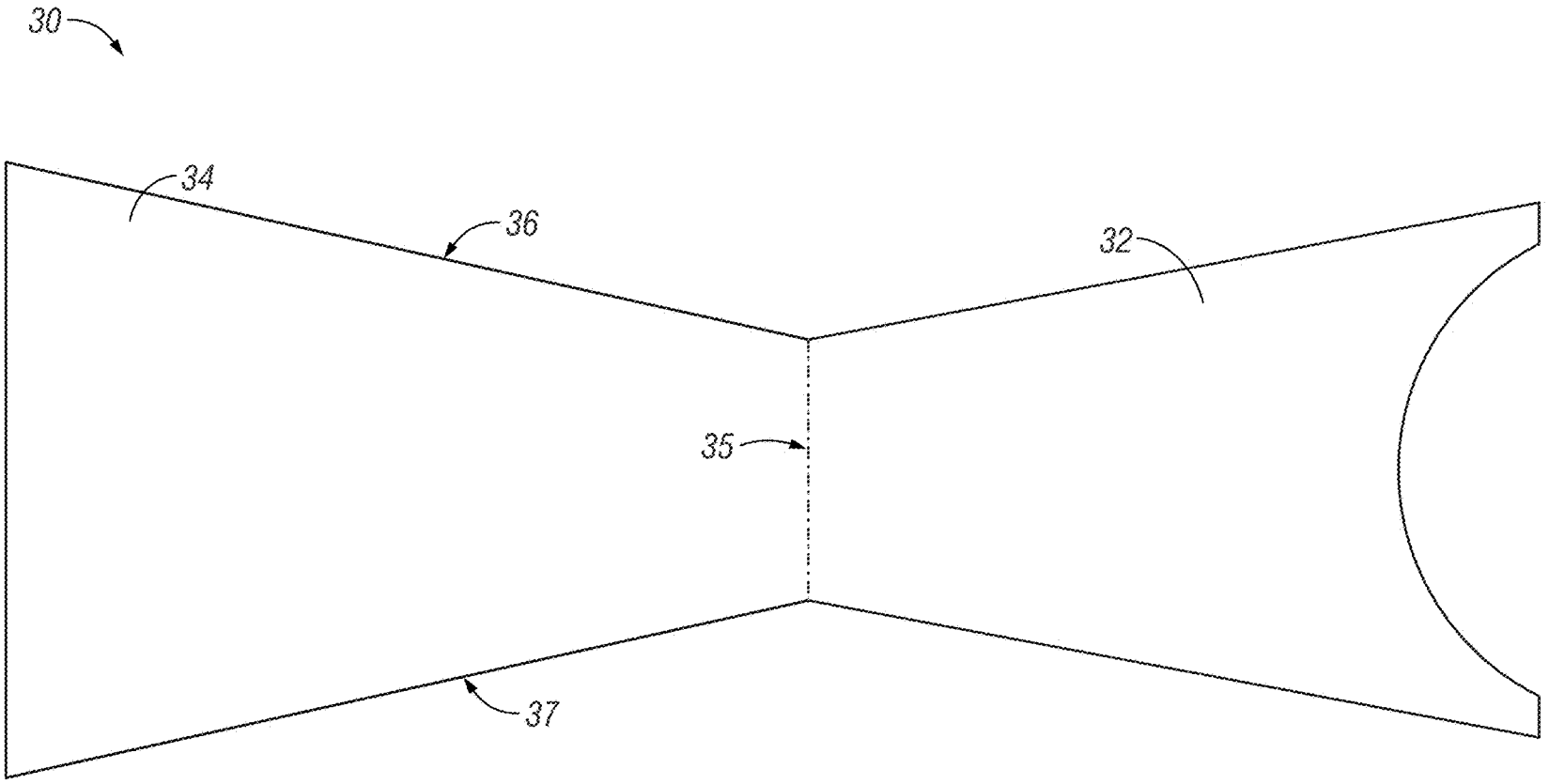
FIG. 4 is a top view of an example embodiment of the fabric pattern for the knife sheath.
Figure 6:
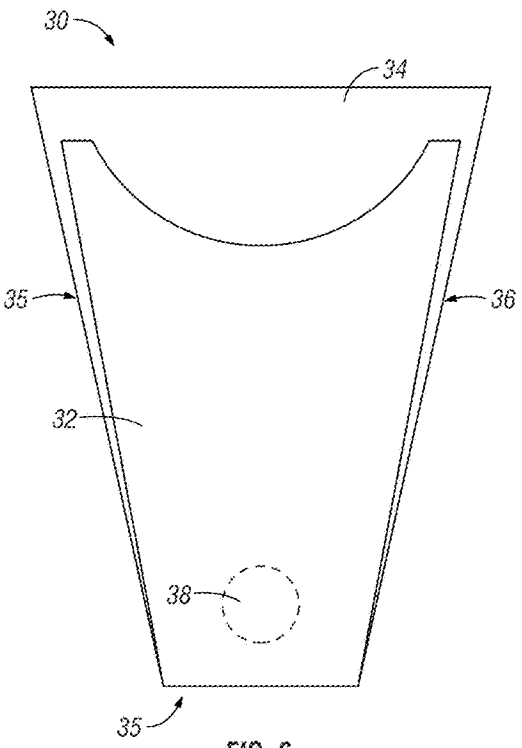
FIG. 6 is a front view of the example embodiment of the knife sheath of FIG. 4.
Figure 5:
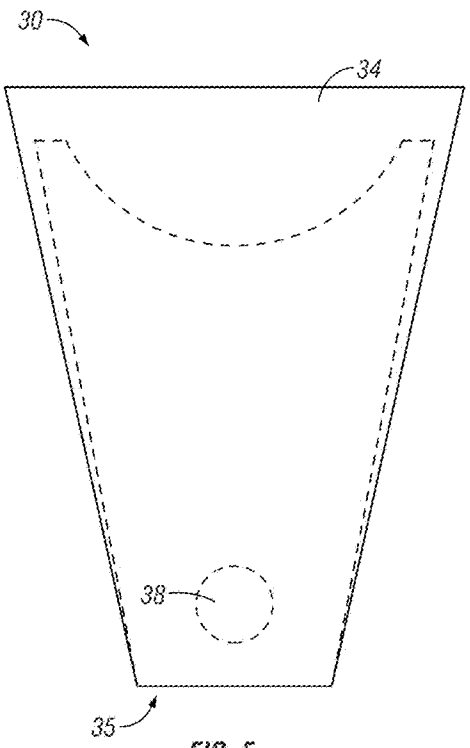
FIG. 5 is a rear view of an example embodiment of the knife sheath.

Referring to FIGS. 4-6, an exemplary embodiment of the pocket 30 is shown. FIG. 4 shows an example fabric pattern for creating a pocket 30 for holding a protective device or item. The pocket may include a front section 32 and a back section. The pocket may be created by pressing, stamping, or cutting the pocket 30 pattern (shown in FIG. 4) from a larger section of fabric. Once the pocket pattern has been cut out, the edges 36, 37 of the fabric may be heated and/or burned to prevent fraying of the fabric. The pattern may then be folded along a center-line 25 to create a pocket between the front section 32 and back section. Then to create the pocket 30, along the edges 36, 37 where the front 32 and back sections 34 meet, the fabric may be sewn, glued, or mated in a similar fashion to create a pocket 30 for a self-defense item or device. The pocket may be made of a web-like material that is both flexible, durable, and cut-resistant. For example, the pocket may be made of a webbed nylon material or Kevlar-like material. It is also contemplated in the present disclosure that the pocket 30 may be manufactured from a water-resistant material. For example, the pocket 30 may be manufactured from nylon, spandex, neoprene, poly-tetrafluoroethylene (PTFE), vinyl, latex, polyurethane, mesh fabric, or similar material. It is also contemplated that the pocket is made from a non-water-resistant fabric, but is treated with a water resistant chemistry. While FIG. 4 shows an example embodiment of a fabric pattern for the pocket 30, it should be understood that the pattern and/or pocket 30 design may be altered or modified to fit different knife, blade, or dagger designs. The pocket 30 design may even be configured to hold an aerosol spray canister, such as pepper spray. The pocket or sheath 30 may also be configured to hold other items or devices that may be used in self-defense. For example, the pocket/sheath 30 may be configured to hold an electronic device configured to dial 911 or contact local authorities when activated by the wearer. The electronic device may also omit a loud sound or include a camera. The pocket/sheath 30 may be configured to hold or conceal a Taser®, flash light, air horn, whistle, or other item designed to alert those in close proximity of danger. Additional examples of items that may also be secured and concealed with the pocket or sheath, include a punch dagger, ninja star, tactical knife, utility knife, combat knife, pepper spray, mace, bear spray, k9 spray, water spray tester, insect spray/replant, animal deterrent spray, emergency alert device/monitor, mobile GPS device/monitor, one touch connect device, stun gun, trigger stun weapon, conducted electrical weapon, stun rod, emergency alarm device, warning sound device, body camera, a flashlight and self-defense weapon combination, or any other device combining any of the aforementioned self-defense products/tools/equipment.

Referring to FIGS. 5 and 6, a rear view (FIG. 5) and front view (FIG. 6) of the pocket 30 are shown. The pocket 30 may include an attachment member 38. For example, a magnet may be sewn or glued into a layer of the pocket 30. The magnet 38 may be configured to removably secure a knife 20, dagger, or aerosol canister securely within the pocket 30. For example, the attachment member 38 may prevent the knife from falling out while the wearer is running, biking, working out, etc., but still allow the wearer to quickly and easily remove the knife 20 or aerosol canister in the event of an attack. The pocket 30 may also similarly be configured to create a snug or formed fit with the knife 20 or canister such that it will not unintentionally fall out of the pocket. Furthermore, an easily removable clasp, snap, button, zipper, or strap may be added to the pocket 30 to removably secure the knife 20 or canister within the pocket 30.

It is contemplated that the pocket 30 may be a knife sheath 30. The sheath may be permanently secured between two fabric layers of the bra 10. For example, the sheath may be sewn into the bra 10, such that the sheath is located between an inner and outer layer of fabric of the front portion 18 of the bra. Alternatively, the sheath 30 may be sewn in between laterally opposing sides 12, 14 of the front portion 18 of the bra 10. For example, the left cup 12 and the right cup 14 portions may be attached to the sheath 30 by sewing the cups to opposing edges 36, 37 of the sheath 30. In this embodiment, only one layer of fabric may be required. It is also contemplated that the sheath 30 may be removably secured to the bra 10 within a pocket 30. The sheath portion 30 of the bra 10 comprises a pocket-like structure capable of receiving the knife 20 or pepper spray. The sheath 30 is made of a high-strength and flexible fabric capable of safely supporting the knife or pepper spray canister such that the knife does not puncture the sheath. Additionally, the sheath 30 is formed to match the shape and length of the knife 20, allowing the knife 20 be securely contained within the sheath. Alternatively, the sheath 30 is formed to match the shape and length of the pepper spray canister allowing the canister to be securely contained. The sheath is placed between the two layers of fabric in the bra 10 and secured by stitching or other means.

Figure 7:
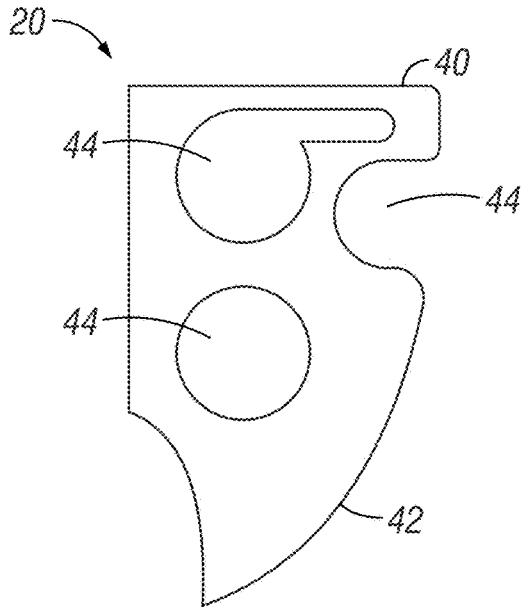
FIG. 7 is a front view of an example embodiment of the knife.
Figure 8:
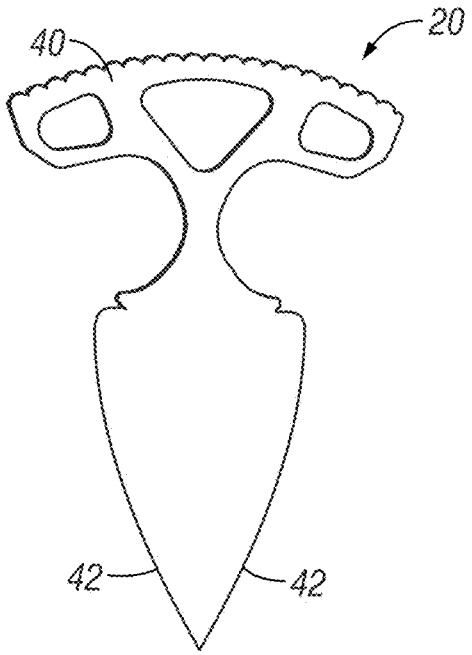
FIG. 8 is a front view of an alternative embodiment of the knife.

FIGS. 7 and 8 represent two embodiments of a knife 20 or dagger that may be removably secured within the pocket or sheath 30 of the bra 10. The knife 20 generally includes a handle portion 40 and a blade portion 42. The knife 20 may include a single blade design, as shown in FIG. 7. Alternatively, the knife 20 may incorporate a double sided blade 42, as shown in FIG. 8. The knife 20 of FIG. 7 also includes one or more apertures or holes 44 that may be configured for inserting the user's finger(s) through. The apertures 44 may be configured and/or oriented to create a comfortable and secure grip for the user. Alternatively, a T-shaped handle 40 is shown in FIG. 8. In both embodiments, the knife 20 is generally small and easily concealable within the pocket or sheath 30 of the bra 10. The handle or grip 40 should be such that the user can quickly and easily grasp the knife 20 to remove from the pocket or sheath 30 of the bra 10 in the event of an attack. The knife 20 is generally comprised of a hard, durable material such as stainless steel, carbon steel, or other similar material.

FIGS. 9 and 10 show alternative locations for incorporating the pocket/sheath 30 in a bra 10. For example, FIG. 9 shows the pocket 30 and knife 20 incorporated in the side strap 20 on the right side of the bra 10. Alternatively, FIG. 10 shows the pocket 30 and knife 20 incorporated in the side strap 20 on the left side of the bra 10. While the pocket 30 as shown in FIGS. 1, 9, and 10 depict the knife 20 oriented in a generally upright or vertical position relative to the bra 10, it should also be understood that the pocket 30 can be positioned and/or oriented such that the knife 20 may be oriented in a generally lateral or downward position. The position and/or orientation of the pocket 30 may be adapted and/or adjusted to ensure the knife 20 is easily and readily accessible to the wearer. It should also be understood that the pocket may be included in the back portion 24 of the bra 10 as well. FIGS. 1, 9, and 10 include example embodiments, but the design and/or concepts discussed above should not be considered to be limited by the figures. It is contemplated that the pocket/sheath may be positioned at various locations within the bra 10 shown. The present invention contemplates numerous variations, options and alternatives, and is not to be limited to the specific embodiments described herein. Other changes are considered to be part of the present invention.

While not shown in the figures, it is contemplated in the present disclosure that the bra 10 and/or pocket 30 for removably securing a knife 20 may be incorporated into other garments or clothing items. For example, the knife 20 and pocket/sheath 30 may be incorporated into the sleeve of a shirt. Alternatively, the knife 20 and pocket/sheath 30 may be incorporated into a compression sleeve that may be worn during everyday activities, or more specifically while working out, jogging, or the like. As described above, the pocket/sheath 30 should be easily concealed within the garment or clothing item, while also being easily accessible to the wearer. Furthermore, it is also contemplated in the present disclosure that the bra 10 comprising a pocket/sheath 30 for removably securing a knife 20 may be incorporated into a shirt or tank top. For example, the bra 10 and pocket 30 may be sewn into or incorporated into a tank top, t-shirt, long sleeve shirt, or compression shirt generally worn while the wearer is working out, jogging, or the like. The cut-resistant pocket configured to safely secure and conceal an item or device used on self-defense, may be incorporated in other articles of clothing like pants, capri pants, yoga pants, compression pants, or a compression sleeve that may be worn on a person arm or leg. The pocket or sheath may also be in incorporated into leggings/joggers, athleisure-wear, hooded sweatshirts, raglan tops, headbands, gloves, shorts, self-defense accessories, razor-back tanks.

What is claimed is:

1. A bra with a pocket comprising:

a front portion comprising a front left portion and a front right portion, said front portion having an inner layer and an outer layer;

one or more side portions extending from opposing sides of the front portion of the bra;

a back portion opposite the front portion, said back portion attached to the front portion by one or more side portions;

said pocket formed between the inner layer and the outer layer of the front portion, said pocket positioned between the front right portion and the front left portion of the front portion;

a sheath comprising a cut-resistant material fitted within the pocket; and a knife removably attached to the sheath.

2. The bra of claim 1, further comprising a molded cup positioned between the inner layer and the outer layer of the left portion and the right portion of the front portion of the bra, said molded cup configured to form to the breast of the wearer of the bra.

3. The bra of claim 2, wherein the molded cup is sized to fit the breast of the wearer of the bra.

4. The bra of claim 1, wherein the inner layer and the outer layer are made of a stretchable material.

5. The bra of claim 4, wherein the stretchable material is a spandex material.

6. The bra of claim 1, wherein the sheath is removably attached to the pocket by a button or a magnet.

7. The bra of claim 1., wherein the sheath is made of a webbed material.

8. The bra of claim 7, wherein the webbed material is a nylon webbing.

9. The bra of claim 1, wherein the knife is a dagger.

10. The bra of claim 1, wherein the sheath further comprises a magnet proximate to an outer surface of the sheath, said magnet configured to removably secure the knife within the sheath.

11. The bra of claim 10, wherein the magnet is sewn into the outer surface of the sheath.

12. The bra of claim 1, wherein the bra is built into a tank top.

13. A bra with a pocket comprising:

a front portion comprising a front left portion and a front right portion, said front portion having an inner layer and an outer layer;

one or more side portions extending from opposing sides of the front portion of the bra;

wherein at least one of the one or more side portions comprises an inner layer and an outer layer;

a back portion opposite the front portion, said back portion attached to the front portion by one or more side portions;

said pocket formed between the inner layer and the outer layer of at least one of the one or more side portions, said pocket positioned between the front right portion and the front left portion of the front portion; and a sheath comprising a cut-resistant material in the pocket.

14. The bra of claim 13, wherein the sheath is configured to removably secure an aerosol container.

15. A method of making a bra with a sheath, said method comprising:

making a bra having inner and outer layers of material;

cutting fabric in a pattern of the sheath;

searing the edges of the cut fabric to prevent fraying of the edges;

folding the cut fabric along a fold line to form the sheath, wherein the sheath is configured to removably secure a knife; and attaching the sheath to the bra between the inner layer and the outer layer of the bra.

16. The method of claim 15, wherein the fabric is a nylon webbing and the nylon webbing is cut using a die.

17. The method of claim 15, wherein the bra comprises a front portion having a left cup portion and a right cup portion and the sheath is attached to the front portion of the bra generally between the left cup portion and the right cup portion.

18. The method of claim 15, wherein the bra comprises one or more side portions and the sheath is attached to at least one of the one or more side portions of the bra.

19. The method of claim 15, further comprising attaching a magnet to an outer surface of the sheath, said magnet configured to removably secure a knife, a dagger, a blade, or an aerosol canister.

* * * * *